US007895772B2

(12) United States Patent
Mariacher

(10) Patent No.: US 7,895,772 B2
(45) Date of Patent: Mar. 1, 2011

(54) CLIMBING SHOE

(75) Inventor: Heinz Mariacher, Carezza (IT)

(73) Assignee: Calzaturificio S.C.A.R.P.A. S.p.A., Asolo (IT)

( * ) Notice: Subject to any disclaimer, the term of this patent is extended or adjusted under 35 U.S.C. 154(b) by 762 days.

(21) Appl. No.: 11/880,415

(22) Filed: Jul. 20, 2007

(65) Prior Publication Data

US 2008/0040950 A1 Feb. 21, 2008

(30) Foreign Application Priority Data

Jul. 21, 2006 (IT) ..... TV2006A0132

(51) Int. Cl.
*A43B 3/00* (2006.01)
*A43B 3/26* (2006.01)

(52) U.S. Cl. ..... 36/113; 36/25 R; 36/97; 36/50.1; D2/907

(58) Field of Classification Search ..... 36/36, 113, 36/97, 88, 90, 8.4, 45, 51, 15, 8.3, 36 R, 25 R, 36/50.1; D2/907
See application file for complete search history.

(56) References Cited

U.S. PATENT DOCUMENTS

| | | | | |
|---|---|---|---|---|
| 3,931,685 | A * | 1/1976 | Laukaitis | 36/128 |
| 5,142,797 | A * | 9/1992 | Cole, III | 36/113 |
| 6,470,599 | B1 * | 10/2002 | Chu | 36/113 |
| 6,862,820 | B2 * | 3/2005 | Farys et al. | 36/51 |
| 6,948,261 | B1 * | 9/2005 | Grasso | 36/15 |
| 7,543,399 | B2 * | 6/2009 | Kilgore et al. | 36/101 |
| 7,634,861 | B2 * | 12/2009 | Kilgore | 36/97 |
| D611,231 | S * | 3/2010 | Parisotto | D2/907 |
| 2003/0196350 | A1 * | 10/2003 | Chu | 36/58.5 |
| 2003/0221337 | A1 * | 12/2003 | Farys et al. | 36/113 |
| 2004/0111921 | A1 * | 6/2004 | Lenormand | 36/45 |
| 2005/0138848 | A1 | 6/2005 | Fullerton | 36/113 |
| 2005/0257405 | A1 * | 11/2005 | Kilgore | 36/97 |

FOREIGN PATENT DOCUMENTS

| | | | |
|---|---|---|---|
| DE | 91 00 662 | U1 | 4/1991 |
| DE | 92 03 949 | U1 | 5/1992 |
| EP | 0688 512 | A | 12/1995 |
| EP | 0 933 033 | A | 8/1999 |

OTHER PUBLICATIONS

European Search Report, 07112901.9-2313, Oct. 30, 2007, 5 pp.

* cited by examiner

*Primary Examiner* — Jila M Mohandesi
(74) *Attorney, Agent, or Firm* — Kenneth L. Sherman, Esq.; Michael Zarrabian, Esq.; Myers Andras Sherman & Zarrabian LLP

(57) ABSTRACT

A climbing shoe having a vamp; a sole fixed to the bottom of the vamp; a substantially horseshoe-shaped first binding covering the tip portion of the vamp surrounding the metatarsus-phalanx area of the sole of the foot; a substantially horseshoe-shaped second binding, which covers the area of the vamp directly over the heel, and extends along the sides of the vamp up to the first binding; and a third binding designed to cover the portion of the vamp at the metatarsus-phalanx area of the sole of the foot, underneath the sole, and to at least partly cover the portion of the vamp at the arch area of the sole of the foot. The third binding has two proximal appendixes and two distal appendixes, which extend on opposite sides of the main body of the third binding.

16 Claims, 2 Drawing Sheets

CLIMBING SHOE

The present invention relates to a climbing shoe.

BACKGROUND OF THE INVENTION

As is known, climbing shoes normally comprise an appropriately shaped leather vamp; a flexible, cured rubber sole glued to the bottom of the vamp; and a number of highly elastic rubber bindings glued to the vamp to surround and grip the foot as tightly as the user can physically withstand, while at the same time enabling the shoe to effectively enclose the foot so the user's weight can be placed safely on the tip of the foot.

More specifically, climbing shoes normally comprise a first substantially horseshoe-shaped binding, traditionally called "tip binding", that covers the portion of the vamp surrounding the metatarsus-phalanx area of the sole of the foot; and a second binding, traditionally called "heel binding", which covers the area of the vamp directly over the heel of the foot (i.e. the part of the foot where the Achilles' tendon joins the calcaneus) and extends along the sides of the vamp up to the sides of the metatarsus-phalanx area of the sole of the foot, where it is connected to the first binding to form a sort of annular elastic tie tightly surrounding and enclosing the foot.

Obviously, the first binding partly covers the bottom of the vamp corresponding to the metatarsus-phalanx area of the sole of the foot; and the flexible, cured rubber sole is glued to the bottom of the vamp, partly over the first and second binding, to form, with the first and second binding, a sort of elastic sheath or cap enclosing and protecting the tip of the foot, and which is connected elastically to the heel of the foot by the second binding.

More recently, climbing shoes have been marketed, in which the cured rubber sole only covers the bottom of the vamp at the metatarsus-phalanx area of the sole of the foot; and the second or "heel" binding only extends along one side of the vamp to cover the bottom of the vamp in the arch and metatarsus-phalanx areas of the sole of the foot, obviously beneath the cured rubber sole. In this case, the shoe also comprises a third binding glued to the bottom of the vamp in the tarsus-calcaneus area, and which extends on the rear of the vamp to also cover the heel area, and is connected to the second or "heel" binding.

SUMMARY OF THE INVENTION

It is an object of the present invention to provide a climbing shoe designed for greater, more uniform enclosure of the user's foot, while at the same time improving comfort and foothold sensitivity of the user.

According to the present invention, there is provided a climbing shoe as claimed in the attached Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Number 1 in FIGS. 1 to 4 indicates as a whole a climbing shoe substantially comprising an appropriately shaped vamp

2, preferably, though not necessarily, made of leather and/or other fabric or porous synthetic material; a flexible sole 3 of cured rubber, Vibram or similar material, glued to the bottom 2*a* of vamp 2 to cover at least the portion of vamp 2 corresponding to the metatarsus-phalanx area $P_1$ of the sole of the foot; and a number of bindings made of rubber or other elastic material, and glued to vamp 2 to uniformly enclose and grip the user's foot.

Figure 2:
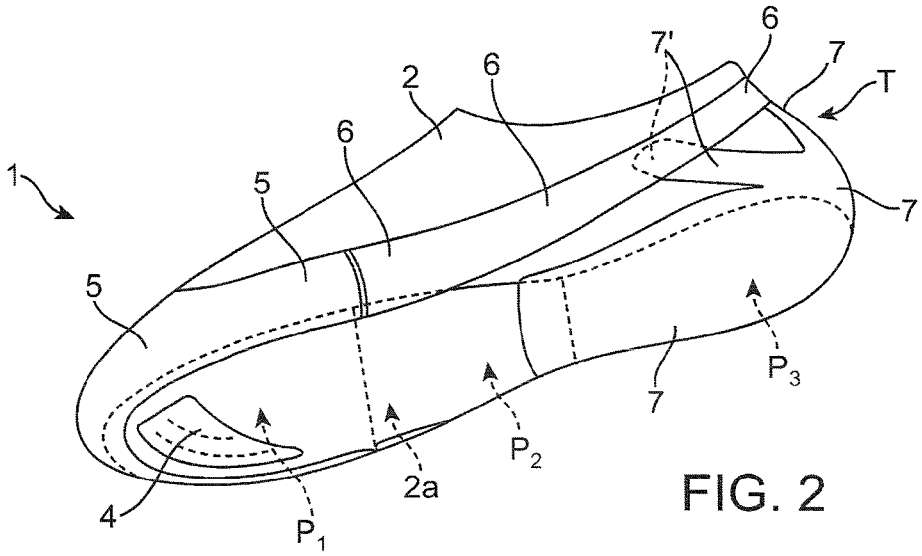
FIGS. 2 to 4 show the FIG. 1 shoe with parts in section and parts removed for clarity.
Figure 3:
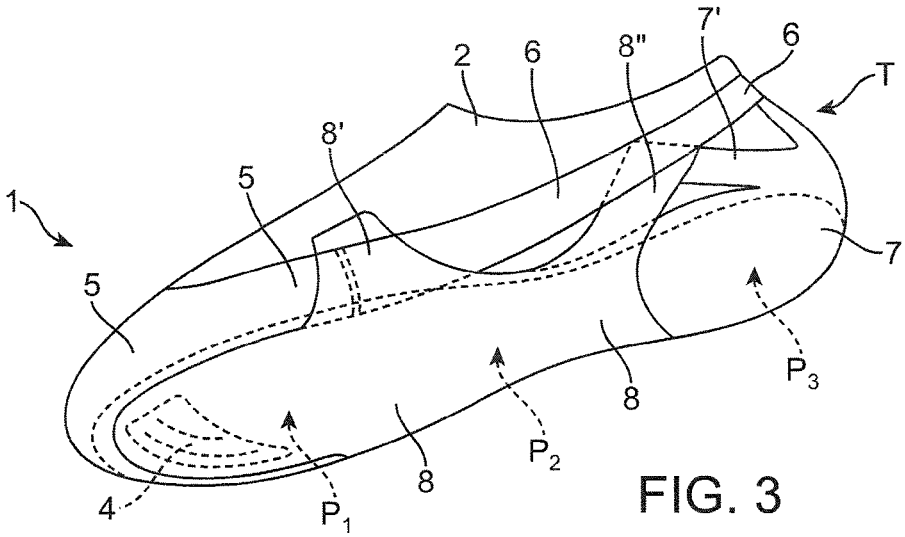

With particular reference to FIGS. 2 and 3, shoe 1 preferably, though not necessarily, also comprises a small, convex, substantially valve-shaped, rigid shell 4, which is preferably, though not necessarily, made of plastic material (e.g. PEBAX), and is glued to the bottom 2*a* of vamp 2 to partly cover the portion of vamp 2 corresponding to the metatarsus-phalanx area $P_1$ of the sole of the foot. Rigid shell 4 is shaped to act as a toe support, and is positioned with its concavity facing away from vamp 2, so that the tip of vamp 2, and therefore of shoe 1, arches downwards.

As regards the various bindings of elastic material, shoe 1, as shown in FIGS. 1 to 4, comprises a first substantially horseshoe-shaped binding 5 covering the tip portion of vamp 2 surrounding the metatarsus-phalanx area $P_1$ of the sole of the foot; and a second substantially horseshoe-shaped binding 6, which covers the area of vamp 2 directly over the heel T of the foot (i.e. the part of the foot where the Achilles' tendon joins the calcaneus), extends along the sides of vamp 2, and joins up with, but without overlapping, binding 5 close to the perimeter of the metatarsus-phalanx area $P_1$ of the sole of the foot.

In the example shown, binding 5 also extends underneath sole 3 to cover part of vamp 2 at the perimeter of the metatarsus-phalanx area $P_1$ of the sole of the foot.

Figure 1:
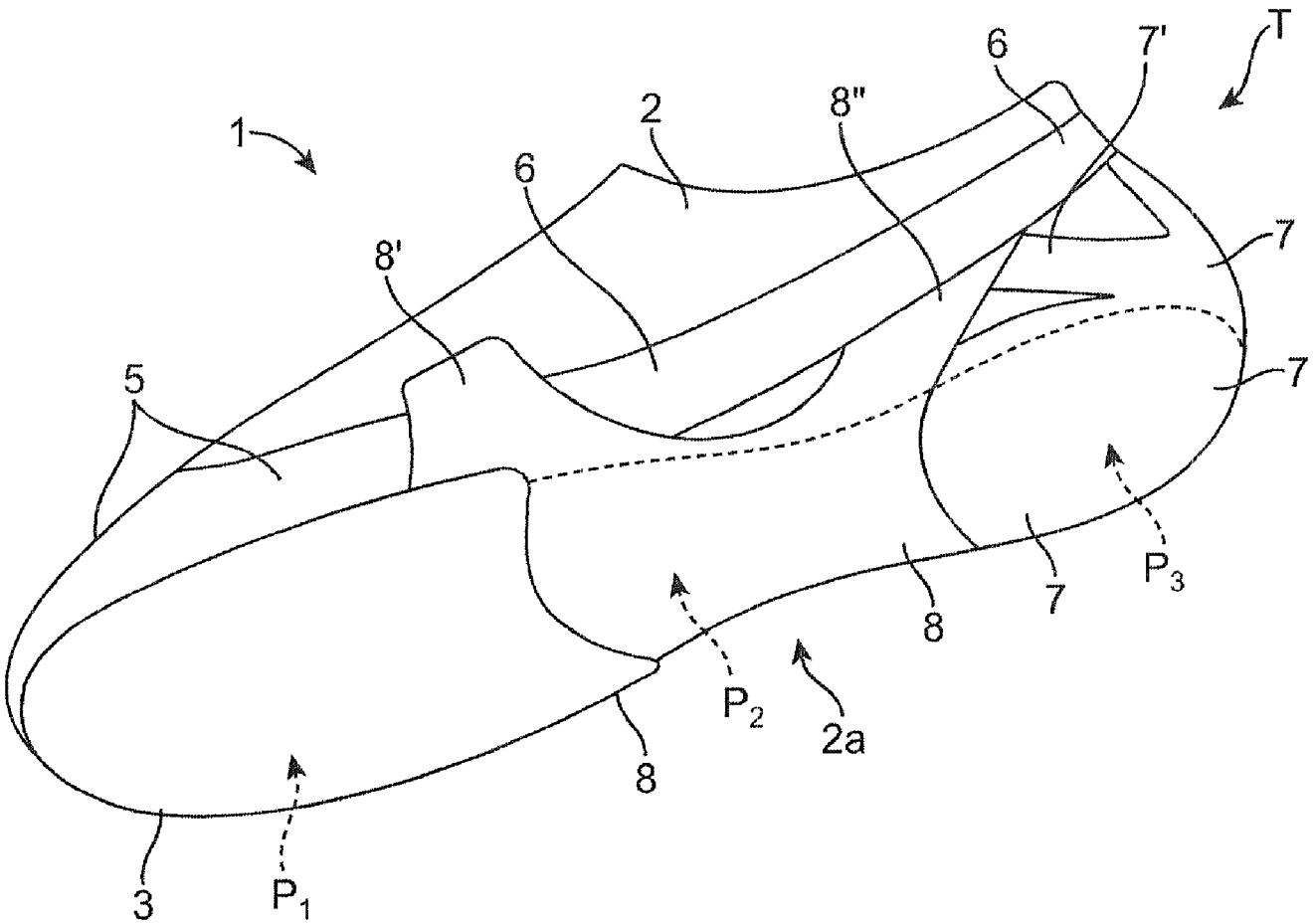
FIG. 1 shows a schematic view in perspective of a climbing shoe in accordance with the teachings of the present invention.

With reference to FIGS. 1, 2 and 3, shoe 1 also comprises a third binding 7 designed to completely cover the portion of vamp 2 at the tarsus-calcaneus area $P_3$ of the sole of the foot, and which also extends along the rear of vamp 2 up to binding 6 to also completely cover the heel T area of the foot.

In addition, binding 7 preferably, though not necessarily, also comprises two transverse appendixes 7', which project, on opposite sides of the main body of binding 7, from the end portion of the tarsus-calcaneus area $P_3$ of the sole of the foot, join up with binding 6 along the two sides of vamp 2, substantially at the join between the astragalus and the calcaneus of the foot, and are inserted beneath binding 6. Binding 7 is obviously glued to binding 6 at all the overlapping points.

Figure 4:
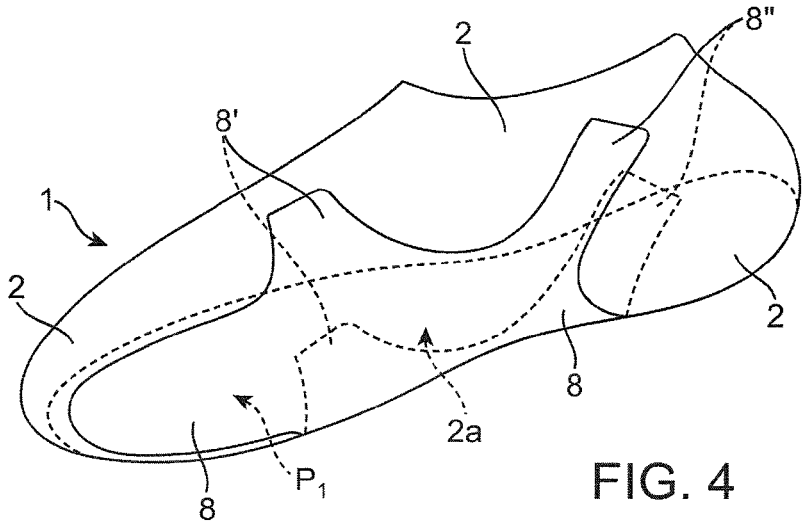

With reference to FIGS. 1, 3 and 4, shoe 1 also comprises a fourth binding 8 designed to completely cover the portion of vamp 2 at the metatarsus-phalanx area $P_1$ of the sole of the foot, obviously underneath sole 3 and over rigid shell 4, and to at least partly cover the portion of vamp 2 at the arch area $P_2$.

Binding 8 also comprises two proximal appendixes 8', which project, on opposite sides of the main body of binding 8 and along the sides of vamp 2, from approximately the borderline between the metatarsus-phalanx area $P_1$ of the sole of the foot and the arch area $P_2$, and overlap bindings 5 and 6 on the sides of vamp 2, roughly at the central segment of the metatarsus.

In addition, binding 8 also comprises two distal appendixes 8", which project, on opposite sides of the main body of binding 8 and along the sides of vamp 2, from approximately the borderline between the arch area $P_2$ and the tarsus-calcaneus area $P_3$ of the sole of the foot, and join up with bindings 6 and 7—or rather, with binding 6 and the two transverse appendixes 7' of binding 7—at the points on the sides of vamp 2 at which bindings 6 and 7 overlap.

In other words, the two distal appendixes 8" of binding 8 extend along the two sides of vamp 2, so that the ends of distal appendixes 8" connect with bindings 6 and 7 substantially at the join between the astragalus and calcaneus of the foot, and preferably, though not necessarily, underneath binding 6.

In this case, too, binding 8 is obviously glued seamlessly to vamp 2, so proximal appendixes 8' and distal appendixes 8" are glued to both vamp 2 and bindings 5, 6 and 7 at all the overlapping points.

In other words, the two distal appendixes 8" and the two proximal appendixes 8' combine to form a substantially X-shaped elastic bandage, which extends from the bottom 2*a* of vamp 2, at arch area $P_2$, to uniformly surround the two sides of vamp 2, and assists in connecting bindings 5 and 6 elastically along the sides of vamp 2, close to where the metatarsal bones join the cuneiforms and cuboids of the foot.

Sole 3, on the other hand, is fixed to the bottom 2*a* of vamp 2, over rigid shell 4 and binding 8, and is designed to completely cover the portion of vamp 2 corresponding to the metatarsus-phalanx area $P_1$ of the sole of the foot, and to only partly cover the portion of vamp 2 corresponding to arch area $P_2$ adjoining metatarsus-phalanx area $P_1$.

Operation of climbing shoe 1 will be clear from the foregoing description, with no further explanation required.

The advantages of shoe 1 are obvious: by virtue of the design of binding 8, bindings 5, 6, 7 and 8 as a whole provide for more completely and more uniformly enclosing the user's foot, and for greatly increasing comfort and the foothold sensitivity of the user.

Clearly, changes may be made to climbing shoe 1 as described and illustrated herein without, however, departing from the scope of the present invention.

For example, in a simplified embodiment shown in FIG. 4, shoe 1 may have no binding 5 and/or 6 and/or 7; in which case, vamp 2 is tightened about the user's foot by the combined action of binding 8 on bottom 2*a* of vamp 2, and the laces closing the opening in the top of vamp 2.

In a further variation not shown, binding 8 may have no distal appendix 8" projecting from the main body of binding 8 and extending along the side of vamp 2 up to the join between the astragalus and calcaneus on the inner side of the foot.

The invention claimed is:

1. A climbing shoe comprising:

a vamp;

a sole irremovably fixed to the bottom of said vamp;

at least a first binding made of elastic material which is irremovably fixed to the bottom of the vamp to uniformly enclose and grip the user's foot and is designed to cover, underneath the sole of the shoe, the portion of the vamp at the metatarsus-phalanx area of the sole of the foot, and to at least partly cover the portion of the vamp at the arch area of the sole of the foot;

a substantially horseshoe-shaped second binding made of elastic material which covers the tip portion of the vamp surrounding the metatarsus-phalanx area of the sole of the foot; and a substantially horseshoe-shaped third binding made of elastic material and which covers the area of the vamp directly over the heel and extends along the sides of the vamp up to said second binding;

said first binding comprising:

two proximal appendixes which project on opposite sides of the main body of the first binding and along the sides of the vamp from approximately the borderline between the metatarsus-phalanx area of the sole of the foot and the arch area and join with the sides of the vamp roughly at the central segment of the metatarsus.

2. The climbing shoe of claim 1, wherein:

the proximal appendixes of the first binding extends along the sides of the vamp and over said second and third binding roughly at the central segment of the metatarsus.

3. The climbing shoe of claim 1, wherein said first binding further comprises:

at least one distal appendix which projects, from the main body of the first binding and along one side of the vamp from approximately the borderline between the arch area and the tarsus-calcaneus area of the sole of the foot, and joins with the side of the vamp roughly at the joint between the astragalus and calcaneus of the foot.

4. The climbing shoe of claim 3, wherein said first binding further comprises:

two distal appendixes which project, on opposite sides of the main body of the first binding and along the sides of the vamp from approximately the borderline between the arch area and the tarsus-calcaneus area of the sole of the foot, and join with the sides of the vamp roughly at the joint between the astragalus and calcaneus of the foot.

5. The climbing shoe of claim 3, wherein:

said at least one distal appendix of the first binding extends along the side of the vamp and over said third binding roughly at the joint between the astragalus and calcaneus of the foot.

6. The climbing shoe of claim 1, wherein:

said at least one distal appendix of the first binding extends along the side of the vamp and over said third binding roughly at the joint between the astragalus and calcaneus of the foot.

7. The climbing shoe of claim 1, further comprising:

a fourth binding made of elastic material and designed to cover the portion of the vamp at the tarsus-calcaneus are of the sole of the foot.

8. The climbing shoe of claim 7, wherein said fourth binding further comprises:

two transverse appendixes which project on opposite sides of the main body of the fourth binding and along the sides of the vamp from the end portion of the tarsus-calcaneus area of the sole of the foot and join with said first and third binding along the two sides of the vamp substantially at the joint between the astragalus and calcaneus of the foot.

9. The climbing shoe of claim 1, wherein said fourth binding further comprises:

two transverse appendixes which project on opposite sides of the main body of the fourth binding and along the sides of the vamp from the end portion of the tarsus-calcaneus area of the sole of the foot and join with said first and third binding along the two sides of the vamp substantially at the joint between the astragalus and calcaneus of the foot.

10. A climbing shoe comprising:

a vamp;

a sole fixed to the bottom of said vamp;

at least a first binding made of elastic material which is fixed to the bottom of the vamp to uniformly enclose and grip the user's foot and is designed to cover the portion of the vamp at the metatarsus-phalanx area of the sole of the foot, underneath the sole, and to at least partly cover the portion of the vamp at the arch area of the sole of the foot;

a substantially horseshoe-shaped second binding made of elastic material which covers the tip portion of the vamp surrounding the metatarsus-phalanx area of the sole of the foot; and a substantially horseshoe-shaped third binding which covers the area of the vamp directly over the heel and extends along the sides of the vamp up to said second binding;

proximal appendixes of said first binding extending along the sides of the vamp and over said second and third binding roughly at the central segment of the metatarsus;

at least one distal appendix of said first binding extending along the side of the vamp and over said third binding roughly at the joint between the astragalus and calcaneus of the foot;

said first binding comprising:

two proximal appendixes which project on opposite sides of the main body of the first binding and along the sides of the vamp from approximately the borderline between the metatarsus-phalanx area of the sole of the foot and the arch area and join with the sides of the vamp roughly at the central segment of the metatarsus; and at least one distal appendix which projects from the main body of the first binding and along one side of the vamp from approximately the borderline between the arch area and the tarsus-calcaneus area of the sole of the foot and joins with the side of the vamp roughly at the joint between the astragalus and calcaneus of the foot.

11. The climbing shoe of claim 10, further comprising:

a fourth binding made of elastic material and designed to cover the portion of the vamp at the tarsus-calcaneus area of the sole of the foot.

12. The climbing shoe of claim 11, wherein said fourth binding comprises:

two transverse appendixes which project on opposite sides of the main body of the fourth binding and along the sides of the vamp from the end portion of the tarsus-calcaneus area of the sole of the foot and join with said first and third binding along the two sides of the vamp substantially at the joint between the astragalus and calcaneus of the foot.

13. A climbing shoe comprising:

a vamp;

a sole fixed to the bottom of said vamp;

at least a first binding made of elastic material which is fixed to the bottom of the vamp to uniformly enclose and grip the user's foot and is designed to cover the portion of the vamp at the metatarsus-phalanx area of the sole of the foot, underneath the sole, and to at least partly cover the portion of the vamp at the arch area of the sole of the foot;

a convex substantially valve-shaped rigid shell fixed to the bottom of the vamp to partly cover the portion of the vamp corresponding to the metatarsus-phalanx area of the sole of the foot;

said rigid shell being positioned with its concavity facing away from the vamp;

said first binding being fixed to the vamp over said rigid shell; and said first binding comprising:

two proximal appendixes which project on opposite sides of the main body of the first binding and along the sides of the vamp from approximately the borderline between the metatarsus-phalanx area of the sole of the foot and the arch area and join with the sides of the vamp roughly at the central segment of the metatarsus; and at least one distal appendix which projects from the main body of the first binding and along one side of the vamp from approximately the borderline between the arch area and the tarsus-calcaneus area of the sole of the foot and joins with the side of the vamp roughly at the joint between the astragalus and calcaneus of the foot.

14. A climbing shoe comprising:

a vamp;

a sole fixed to the bottom of said vamp;

at least a first binding made of elastic material which is fixed to the bottom of the vamp to uniformly enclose and grip the user's foot and is designed to cover the portion of the vamp at the metatarsus-phalanx area of the sole of the foot, underneath the sole, and to at least partly cover the portion of the vamp at the arch area of the sole of the foot;

wherein said sole is designed to completely cover the portion of the vamp corresponding to the metatarsus-phalanx area of the sole of the foot and to only partly cover the portion of the vamp corresponding to the arch area adjoining the metatarsus-phalanx area;

said first binding comprising:

two proximal appendixes which project on opposite sides of the main body of the first binding and along the sides of the vamp from approximately the borderline between the metatarsus-phalanx area of the sole of the foot and the arch area and join with the sides of the vamp roughly at the central segment of the metatarsus; and at least one distal appendix which projects from the main body of the first binding and along one side of the vamp from approximately the borderline between the arch area and the tarsus-calcaneus area of the sole of the foot and joins with the side of the vamp roughly at the joint between the astragalus and calcaneus of the foot.

15. A climbing shoe comprising:

a vamp;

a sole irremovably fixed to the bottom of said vamp;

at least a first binding made of elastic material which is irremovably fixed to the bottom of the vamp to uniformly enclose and grip the user's foot and is designed to cover, underneath the sole of the shoe, the portion of the vamp at the metatarsus-phalanx area of the sole of the foot, and to at least partly cover the portion of the vamp at the arch area of the sole of the foot; and a convex substantially valve-shaped rigid shell fixed to the bottom of the vamp to partly cover the portion of the vamp corresponding to the metatarsus-phalanx area of the sole of the foot;

said first binding comprising:

two proximal appendixes which project on opposite sides of the main body of the first binding and along the sides of the vamp from approximately the borderline between the metatarsus-phalanx area of the sole of the foot and the arch area and join with the sides of the vamp roughly at the central segment of the metatarsus;

said rigid shell being positioned with its concavity facing away from the vamp; and said sole and said first binding being fixed to the vamp over said rigid shell.

16. A climbing shoe comprising:

a vamp;

a sole irremovably fixed to the bottom of said vamp;

at least a first binding made of elastic material which is irremovably fixed to the bottom of the vamp to uniformly enclose and grip the user's foot and is designed to cover, underneath the sole of the shoe, the portion of the vamp at the metatarsus-phalanx area of the sole of the foot, and to at least partly cover the portion of the vamp at the arch area of the sole of the foot;

said first binding comprising:

two proximal appendixes which project on opposite sides of the main body of the first binding and along the sides of the vamp from approximately the borderline between the metatarsus-phalanx area of the sole of the foot and the arch area and join with the sides of the vamp roughly at the central segment of the metatarsus;

said sole is designed to completely cover the portion of the vamp corresponding to the metatarsus-phalanx area of the sole of the foot and to only partly cover the portion of the vamp corresponding to the arch area adjoining the metatarsus-phalanx area.

* * * * *